US006924465B2

(12) United States Patent
Schilling et al.

(10) Patent No.: US 6,924,465 B2
(45) Date of Patent: Aug. 2, 2005

(54) DISPLAY DEVICE WITH ILLUMINATING DEVICE FOR A DOMESTIC ELECTRIC HEATING APPARATUS

(75) Inventors: Wilfried Schilling, Kraichtal (DE); Christian Egenter, Bretten (DE); Alfred Fischer, Sulzfeld (DE); Juergen Katzenmayer, Kuernbach (DE); Oliver Gremm, Kuernbach (DE)

(73) Assignee: E.G.O. Elektro-Geraetebau GmbH (DE)

( * ) Notice: Subject to any disclaimer, the term of this patent is extended or adjusted under 35 U.S.C. 154(b) by 0 days.

(21) Appl. No.: 10/693,533

(22) Filed: Oct. 24, 2003

(65) Prior Publication Data

US 2004/0089466 A1 May 13, 2004

(30) Foreign Application Priority Data

Nov. 7, 2002 (DE) ..... 202 17 528 U

(51) Int. Cl.[7] ..... H05B 3/68
(52) U.S. Cl. ..... 219/445.1; 219/448.11
(58) Field of Search ..... 219/443.1, 445.1, 219/446.1, 448.11, 448.12, 460.1, 461.1, 462.1, 483; 126/39 J, 39 H, 90 A, 92 AC, 92 A

(56) References Cited

U.S. PATENT DOCUMENTS

| | | | | |
|---|---|---|---|---|
| 4,121,204 A | * | 10/1978 | Welch et al. | 345/174 |
| 4,327,280 A | * | 4/1982 | McWilliams | 219/448.19 |
| 5,013,893 A | * | 5/1991 | Goessler et al. | 219/445.1 |
| 5,162,636 A | * | 11/1992 | Randolph et al. | 219/445.1 |
| 5,448,036 A | * | 9/1995 | Husslein et al. | 219/445.1 |
| 5,750,959 A | * | 5/1998 | Plumptre | 219/445.1 |
| 5,809,680 A | * | 9/1998 | Scheidler et al. | 40/580 |
| 6,376,809 B1 | * | 4/2002 | Huber et al. | 219/445.1 |

* cited by examiner

*Primary Examiner*—Sang Paik
(74) *Attorney, Agent, or Firm*—Akerman Senterfitt

(57) ABSTRACT

The invention provides according to one example a display device for a domestic electric heating appliance, such as for example a glass ceramic hob, the electric heating appliance having at least one heating device. The latter is subdivided into several flat heating areas, which can be activated at least partly independently of one another and/or singly for heating operation. The display device optically displays the heating operation or the activation of individual heating areas. For this purpose it has individually activatable illuminating devices. The illuminating devices are constructed as separate segments of a geometrical basic shape, such as a rectangle or preferably a circle. For each display device there are two basic shapes of the same nature, but different size and having a concentric arrangement.

20 Claims, 1 Drawing Sheet

DISPLAY DEVICE WITH ILLUMINATING DEVICE FOR A DOMESTIC ELECTRIC HEATING APPARATUS

FIELD OF APPLICATION AND PRIOR ART

The invention relates to a display device for a domestic electric heating apparatus. Such electric heating apparatuses are for example glass ceramic hobs, where a radiant heater can be positioned beneath the hob, or induction heating hobs.

The electric heating apparatus has at least one heating device subdivided into several flat heating areas, which can be at least partly independently or singly activated for heating operation. It is for example a radiant heater with an inner circle and outer circle. For large diameter cooking vessels an outer circle is additionally activated. This is also understood to cover shapes for fryers.

It is frequently desirable to indicate to the user the operation of the outer zone in addition to the inner zone. This is for example brought about using LEDs. Thus, during the additional operation of an outer zone, a LED is activated and by its light emission it indicates the activation of the outer zone. It is also possible, for example for fryers, to activate additional heating areas, which are planar and positioned laterally of a circular zone and whose activation can also be displayed by means of a LED.

It is fundamentally possible in this way to indicate the additional activation of heating areas to the user. However, this frequently does not show in what form a further heating area has been activated. In particular, such displays are not very appealing or informative.

PROBLEM AND SOLUTION

The problem of the invention is to provide a display device providing a more comfortable and detailed display of the operation of individual heating areas of a heating device, whilst in particular permitting a faster, instinctive determination of the displayed state by a user.

This problem is solved by a display device with the features of claim 1. Advantageous and preferred developments of the invention form the subject matter of further claims and are described in greater detail hereinafter. By express reference the wording of the claims is made into part of the content of the description.

According to the invention the illuminating devices are constructed as separate segments of a geometrical basic shape. Such a geometrical basic shape is a circle, rectangle or square. For each display device two basic shapes of the same type are provided having a different size and a concentric arrangement. This can symbolize an aforementioned inner circle and outer circle.

Through the subdivision of such an illuminatable basic shape, which on the one hand is flat and therefore already symbolically represents a flat heating device, and on the other through subdivision into segments allows numerous representation possibilities, detailed information can be provided to the user. More particularly through the individual activatability of the illuminating devices and therefore also the individual segments of the flat basic shape, it is possible not only to have a so-to-speak digital information (further heating area switched on or off). In a clear manner further information can be represented, for example at what point a further heating area has been activated. It is advantageously possible with the invention to reproduce the shape of a heating device to a certain extent in detail-true manner. Finally, for example in the case of radiant heaters, the user recognizes the shape from the illuminated image of the radiant heater.

According to a further development of the invention it is possible, apart from the at least two concentric basic shapes, to provide at least one further illuminating device with at least one segment, which has a limited spacing from the basic shapes or the larger of the two basic shapes. The subdivision of the further illuminating device into segments permits once again the above-described, detailed representation of states or information. It is possible to construct said further illuminating device in the manner of a half or a divided into half basic shape alongside which it is positioned. Thus, if the basic shapes are circles, the further illuminating device is a semicircle or has segments forming a semicircle.

Preferably such a laterally positioned, further illuminating device is constructed in the same way as the other illuminating devices, i.e. with at least one segment. Preferably all the segments of a display device are of the same nature, even if they have different sizes. This allows a uniform type of representation and this is advantageous for the rapid recording of the information.

In addition to the two basic shapes, it is possible to have a further, third basic shape which is of a similar type and arranged concentrically to the two other basic shapes, but which differs as regards size. It is advantageous here if in the case of three concentric, similar basic shapes, the size differences are linear with respect to one another in the shape, so that for example in each case one step from a smaller shape to the larger basic shape represents a diameter change of a fixed amount, which can for example be 3, 4 or 5 mm. The basic shapes are preferably circular, because conventionally also radiant heaters and therefore the illuminated images produced by them are circular.

The segments can be constructed as angular portions of the basic shape. They advantageously extend over an angle of 90ø, so that a basic shape is subdivided into four segments. The segments can be flat, for example quadrants. Alternatively or with a further basic shape surrounding such a flat basic shape, they can have a linear construction. They then pass along the circumference of the basic shape and consequently represent the same. Linear segments are preferred because a more uniform illumination is possible over their smaller surface and the representation types are more varied.

The segments can either pass seamlessly into one another in such a way that when all the segments of a basic shape are illuminated, they form a closed and continuous surface. They can alternatively be separated from one another or have a small spacing from one another. This is possible through unilluminated bridges or separating areas. Such displays roughly correspond to so-called seven segment displays. Here again there is a separation of the individual segments. This makes manufacture easier and generally the representation type is more pleasing.

According to an advantageous development of the invention the illuminating devices are constructed in such a way that they represent different size heating devices or heating devices with an inner circle and an outer circle, as well as heating devices with additional heating areas positioned laterally alongside the same through a corresponding simulation of the heating areas with the segments. Thus, light emitting segments indicate which heating areas are active.

More particularly this is shown by the fact that they are in a roughly flat arrangement or association with one another. This makes it very easy for the user to rapidly and intuitively establish the displayed information.

For the illuminating devices it is advantageous to provide light emitting means. A light emitting means illuminates at least one segment and in certain circumstances also several segments. In particularly preferred manner a light emitting means illuminates two segments, which form half a basic shape or a half basic shape. The choice of light emitting means is very wide. Preferably use is made of LEDs, because they are obtainable with different shapes and colours.

In a variant of the invention it is possible for the light emitting means, for example in LED form, to have a body with a segmental shape. A light emitting means with such a body consequently forms an illuminating device and is advantageously a single component or module. For example a LED can be a plastic body with a segmental shape, for example a quadrantal or quadrantal arcuate shape. In a preferred development of the invention the light emitting means can have a random shape. They are positioned beneath a mask or cover, which has openings or transparent areas with the shape of the segments. It is consequently possible to place over a random light source a mask producing the segment shape.

It is also possible according to the invention to position above the light emitting means light dividing or light conducting parts. Advantageously use is made of translucent or coloured plastic. Such light distributing or light conducting elements are advantageous if it is a question of uniformly distributing over the flat segment shape substantially punctiform illuminating devices, light emitting means or light sources. For example they can also be diffusing or scattering foils or the like.

It is possible to construct the display device as a module. It can have a casing with several electrical connections or terminals which are connected to the light emitting means. A covering mask is also provided, having openings corresponding to the shape of the segments. Such a module is a single component, for example corresponding to a seven segment display.

It is alternatively possible to provide a module having openings or transparent areas corresponding to the shape of the segments of the display device. The module can be fitted by means of separate light emitting means, which are for example mounted on a printed circuit board. This has the advantage that it is only necessary to manufacture one such casing, preferably from plastic and for example by injection moulding. It can be placed on random, standardized light emitting means, for example LEDs for producing the display device.

The display device is advantageously connected to a control, more especially for the electric heating apparatus. For every heating device forming a cooking point of the electric heating apparatus, a display device can be provided and represents the state of said heating device. The control is constructed in such a way that it can represent operation, i.e. the heating area of the heating device to be changed, by means of the illuminating devices or the individual segments of the display device. Such a control can have a similar operation to those controlling seven segment displays.

It is also possible to construct the control with a printed circuit board which, apart from circuitry components and electronics, particularly for the heating device, has at least one display device according to the invention. Advantageously there is a display device for each heating device. For every heating device, the control or printed circuit board has at least one operating or control element, for example touch contact switches. Apart from such a control element, such a display device is provided and advantageously with a limited spacing. This makes it clear that said display device displays the state of a heating device with which the control means can also be operated.

Conventional controls for glass ceramic hobs with four heating devices have four display devices with in each case four control elements, for example. The display devices can all be identical, even if the heating device is not itself identically constructed. Even for heating devices having only a single heating area, such a display device can be provided and has several functions. These functions are not used by the control. As a result expenditure for different components is low.

These and further features can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subheadings in no way limits the general validity of the statements made thereunder.

BRIEF DESCRIPTION OF THE DRAWINGS

Embodiments of the invention are described in greater detail hereinafter relative to the diagrammatic drawings, wherein show.

DETAIL DESCRIPTION OF THE EMBODIMENTS

Figure 1:
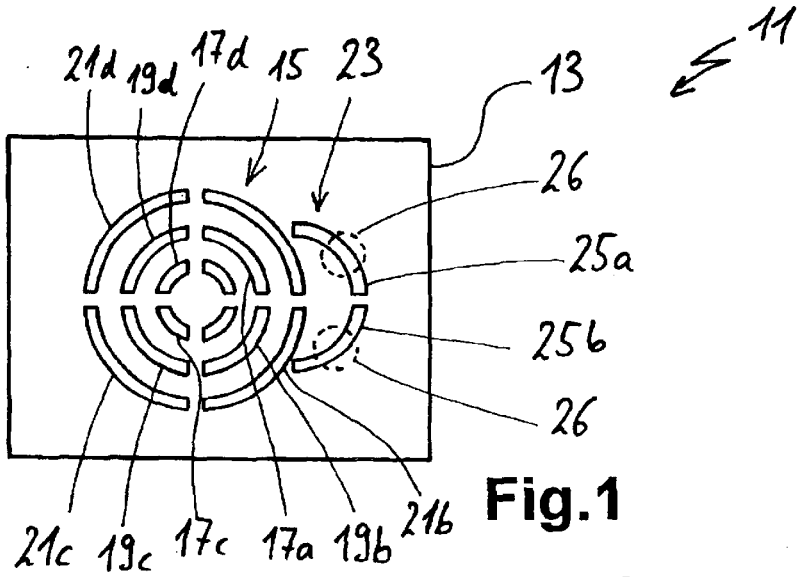
FIG. 1 A plan view of a display device with three circles as basic shapes and quadrantal arcuate segments, together with two quadrantal arcuate segments forming a semicircle and positioned laterally alongside the same.

FIG. 1 shows a possible embodiment of the invention. A display device 11 has a rectangular mask 13 containing segments, which are for example openings in the mask. Otherwise the mask is opaque and the openings are transparent.

In the centre there are three central basic shapes 15 in circular form. The innermost basic shape comprises innermost segments 17, the central basic shape comprises central segments 19 and the outermost basic shape comprises outermost segments 21. The three basic shapes are in each case formed by quadrantal arcuate segments 17, 19 or 21 and are numbered continuously from a to d in the clockwise direction.

The central basic shape or the central segments 19 forming the same are positioned in size-corresponding manner to the right and alongside the basic shapes 15 of lateral illuminating devices 23. The latter comprise two lateral segments 25*a*, 25*b*. They are constructed in accordance with the central segments 19, i.e. as quadrantal arcuate segments. They roughly correspond to the central segments 19*a*, 19*b* and are merely displaced laterally to the right. Thus, if the left-hand, central segments 19*c*, 19*d* and the two lateral segments 25*a*, 25*b* are alone in operation or emit light, an elongated heating zone can be represented, which corresponds to the above-described fryer. The shape thereof is known to the expert and need consequently not be explained further here.

FIG. 1 is particularly intended to show the possibility of constructing the illuminating devices or segments. The construction therein is provided with a mask and segments 17, 19, 21 and 25 located in the latter. It is possible for each of the segments to be individually illuminated. However, for simplification purposes, it is possible for the central basic shapes 15 to jointly, but separately illuminate two left-hand segments c and d and two right-hand segments a and b.

In place of such a general possibility of providing a mask 13 with individual segments 17, 19, 21 and 25, it is also conceivable to create a display device similar to that of FIG. 1 in the form of a unit and similar to a seven segment display. Then light emitting means, for example LEDs, would be embedded or integrated into a casing roughly corresponding to the mask 13 and represented to the right in broken line form as LED 26.

Figure 2:
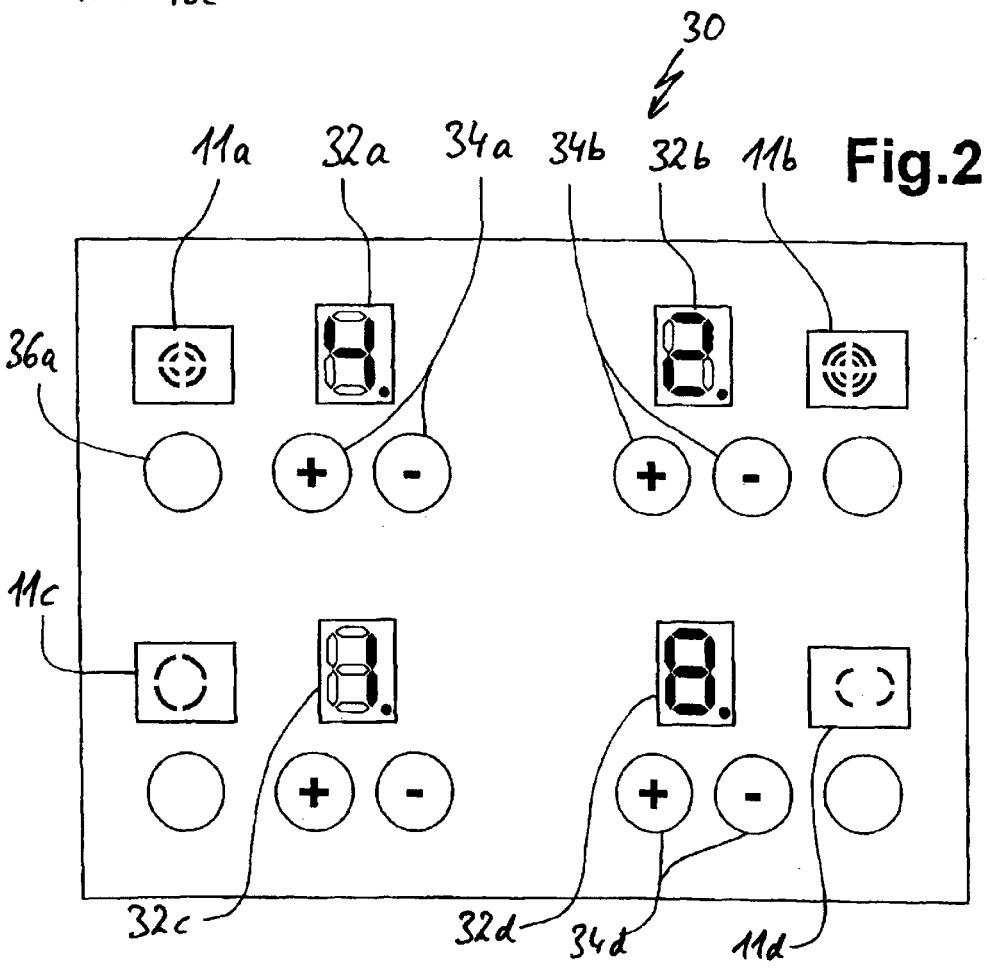
FIG. 2 A plan view of a control for four heating devices with in each case a display device, a seven segment display and control elements.

FIG. 2 shows a control 30, which is able to control four heating devices. Thus, for each heating device is provided a display device 11, a even segment display 32, particularly for a cooking stage display, and two touch contact switches 34. The touch contact switches are a positive switch and a negative switch for increasing or decreasing the power of the cooking point. This power is then displayed with the seven segment display 32. There is also another touch contact switch 36, which can be used for activating the cooking point or for activating operation by means of the touch contact switches 34. By means of the additional touch contact switch 36 it is for example possible to switch on or off additional circuits or heating means or further heating areas of a heating device of a cooking point. Such a control, particularly with touch contact switches 34 and 36 is known per se, so that further details are not required here.

It is possible to see with respect to the four display devices 11*a* to 11*d*, the different modes of representation possible with the display device according to the invention. As stated, they correspond to the different possible operating states of the individual cooking points associated with the display devices 11. As intimated hereinbefore, the cooking points can, for example, be radiant heaters.

At the top left the display device 11*a* displays the operation of a heating device, where the innermost and central cooking zones are active. This is apparent from the fact that in connection with the display device 11*a* the innermost segments 17 and the central segments 19 of the central basic shapes 15 emit light. Light emission is illustrated by the fact that the corresponding segments are dark-hatched.

It is visible here and this also applies with the other heating devices or seven segment displays 32, at what power stage the heating device is operated and to the top left it is stage 4.

The display device 11*b* at top right displays the fact that the particular heating device is operated with three concentric heating areas. Segments 17, 19 and 21 of the three central basic shapes 15 are in operation or emit light.

In the case of the display device 11*c* bottom left in FIG. 2, only the outermost segments 21 are in operation or emit light. This can mean that in the case of the corresponding heating device only an outermost heating area is active. It can also mean that the corresponding heating device only has a single heating area and that this is at present in operation. Thus, as with the display devices 11*a* and 11*b*, by illuminating the segments of different basic shapes, it is possible to illustrate the operation of the corresponding heating devices, either with the particular heating areas or in general. Through a display, such as for display device 11*c*, it can be shown that here a heating device is in operation, which under certain circumstances only has a single heating area or range.

The display device 11*d* bottom right emits light with the two left-hand, central segments 19*c*, 19*d* of central basic shape 15 and lateral segments 25*a*, 25*b* of the lateral illuminating devices 23. This can illustrate the possibility that here a heating device is active, whose single operating mode involves an elongated heating surface, for example in the nature of a fryer. According to another possibility it is also possible to display the operation of an elongated heating device with a fryer function. However, here it would also be possible to activate lateral heating areas corresponding to the lateral segments 25 in addition to a central heating area, which would correspond to a central basic shape 15. Both possibilities can be represented with a display device according to the invention.

Thus, from the basic representation possibilities according to FIG. 1 and the exemplified representation according to FIG. 2, it is clear to what extent in the case of differently constructed heating devices for a hob, the operating states thereof can be represented in a clear and instinctively determinable manner through the display devices.

In a corresponding application of the invention to further electric heating apparatuses, for example baking ovens, it is apparent how also then in the presence of one or more heating devices with in each case several heating areas, the activation of different heating areas can be represented. However, a display device according to the invention is used in preferred manner for those cooking points with heating devices where the latter have different, flat heating areas.

What is claimed is:

1. A display device for a domestic electric heating apparatus, the electric heating apparatus having at least one heating device subdivided into several flat heating areas, wherein the several flat heating areas can be activated at least partly independently of one another and/or singly for heating operation, said display device comprising:

individually activatable illuminating devices to optically display the heating operation or the activation of the individual heating areas, wherein said illuminating devices are constructed as separate segments of a geometrical basic shape, wherein for each said display device there are two basic shapes of the same nature, the two basic shapes being of different sizes and being concentrically arranged, and wherein said display device is separate from the heating device.

2. The display device according to claim 1, wherein there is provided at least one additional illuminating device with at least one segment, and is positioned laterally and with limited spacing alongside said basic shapes.

3. The display device according to claim 2, wherein said additional illuminating device is constructed in the manner of a half or half-divided basic shape of said aforementioned basic shapes.

4. The display device according to claim 2, wherein said additional, laterally positioned illuminating device is constructed in the same way with at least one segment and corresponding to one of said segments of said basic shapes.

5. The display device according to claim 1 wherein an additional, third, concentric, similar basic shape is provided, whose size differs from that of the two said basic shapes.

6. The display device according to claim 1, wherein said segments are constructed as angular portions of said basic shape either flat or linearly along their circumference.

7. The display device according to claim 6, wherein said segments extend over an angle of 90°.

8. The display device according to claim 1, wherein said segments are separated from one another by unilluminated bridges or separating areas.

9. The display device according to claim 1, wherein said illuminating devices are constructed in such a way that they represent hearing devices of different sizes, as well as heating devices with heating areas positioned laterally alongside the same.

10. The display device according to claim 1, wherein light emitting means are provided for said illuminating devices, one said light emitting means illuminating at least one said segment.

11. The display device according to claim 10, wherein a single light emitting means illuminates two said segments in the manner of half a basic shape.

12. The display device according to claim 10, wherein said light emitting means are LEDs.

13. The display device according to claim 10, wherein said light emitting means have a body in segmental form, said light emitting means with said body farming one said illuminating device.

14. The display device according to claim 10, wherein said light emitting means are positioned beneath a mask or a cover having openings or transparent areas with the shape of said segments.

15. The display device according to claim 10, wherein light distributing or light conducting parts made from transparent or coloured plastic are positioned above said light emitting means.

16. The display device according to claim 8, being constructed as a module and having a casing with several electrical terminals for said light emitting means and a covering mask with openings corresponding to the shape of said segments.

17. The display device according to claim 8, wherein there is a module having openings or transparent areas corresponding to the shape of said segments, the module being fittable by means of separate light emitting means and is mechanically retained by the same.

18. The display device according to claim 1, wherein it is connected to a control and for each said heating device forming a cooking point there is one said display device and said control is constructed for representing the operation of said individual beating areas by means of said illuminating devices of said display device.

19. The display device according to claim 18, wherein said control has a printed circuit board which, in addition to circuitry components and electronics, has at least one said display device.

20. The display device according to claim 19, wherein, for each said heating device, said printed circuit board has at least one control element, alongside which there is one said display device.

* * * * *